US010906623B2

(12) United States Patent
Chan et al.

(10) Patent No.: US 10,906,623 B2
(45) Date of Patent: Feb. 2, 2021

(54) MARINE VESSEL CONTROL SYSTEM FOR CONTROLLING MOVEMENT OF A MARINE VESSEL HAVING FOUR PROPULSION UNITS

(71) Applicant: Marine Canada Acquisition Inc., Richmond (CA)

(72) Inventors: Anson Chin Pang Chan, Richmond (CA); Geoffrey Duddridge, Richmond (CA)

(73) Assignee: Marine Canada Acquisition Inc., Richmond (CA)

( * ) Notice: Subject to any disclaimer, the term of this patent is extended or adjusted under 35 U.S.C. 154(b) by 0 days.

(21) Appl. No.: 15/118,682

(22) PCT Filed: Feb. 13, 2015

(86) PCT No.: PCT/CA2015/050107
§ 371 (c)(1),
(2) Date: Aug. 12, 2016

(87) PCT Pub. No.: WO2015/120555
PCT Pub. Date: Aug. 20, 2015

(65) Prior Publication Data

US 2017/0050715 A1 Feb. 23, 2017

Related U.S. Application Data

(60) Provisional application No. 61/939,735, filed on Feb. 13, 2014.

(51) Int. Cl.
*B63H 25/42* (2006.01)
*B63H 20/12* (2006.01)
(Continued)

(52) U.S. Cl.
CPC ..... *B63H 25/42* (2013.01); *B63H 20/12* (2013.01); *B63H 21/21* (2013.01);
(Continued)

(58) Field of Classification Search
CPC .. B63H 20/12; B63H 2020/003; B63H 21/21; B63H 25/42; B63H 2025/026; B63H 2025/022
See application file for complete search history.

(56) References Cited

U.S. PATENT DOCUMENTS 6,234,853 B1 5/2001 Lanyi et al.
6,561,860 B2 * 5/2003 Colyvas ..... B63H 20/12 440/59
(Continued)

FOREIGN PATENT DOCUMENTS

CA 2532408 A1 7/2006
WO WO2007105995 A1 9/2007
(Continued)

OTHER PUBLICATIONS

European search report issued by European Patent Office against corresponding European Union Patent Application No. 15748631.7, dated Oct. 4, 2017.

*Primary Examiner* — Ajay Vasudeva
(74) *Attorney, Agent, or Firm* — Berenato & White, LLC

(57) ABSTRACT

A marine vessel control system comprises an outer port engine which has an actuator for imparting steering motion to the outer port engine and an outer starboard engine which has an actuator for imparting steering motion to the outer starboard engine. There is an inner port engine and a tie bar coupling the inner port engine to the outer port engine. There is an inner starboard engine and a tie bar coupling the inner starboard engine to the outer starboard engine. There is an input device for inputting user steering commands to the marine vessel control system in which movement of the
(Continued)

input device actuates the said actuators to impart steering motion to the said engines.

20 Claims, 13 Drawing Sheets

(51) Int. Cl.
*B63H 21/21* (2006.01)
*B63H 20/00* (2006.01)
*B63H 25/02* (2006.01)

(52) U.S. Cl.
CPC .. *B63H 2020/003* (2013.01); *B63H 2025/022* (2013.01); *B63H 2025/026* (2013.01)

(56) References Cited

U.S. PATENT DOCUMENTS

| | | | | |
|---|---|---|---|---|
| 7,207,854 | B1 | 4/2007 | Anderson, Jr. et al. | |
| 8,425,270 | B2 * | 4/2013 | Dudra | B63H 20/08 440/53 |
| 8,589,004 | B1 | 11/2013 | Kanno | |
| 9,272,765 | B2 * | 3/2016 | Lindeborg | B63H 25/02 |
| 9,771,137 | B1 * | 9/2017 | Gable | B63H 20/12 |
| 2010/0191397 | A1 | 8/2010 | Nose | |
| 2013/0284080 | A1 | 10/2013 | Davidson | |

FOREIGN PATENT DOCUMENTS

| | | |
|---|---|---|
| WO | 2013/122515 | 8/2013 |
| WO | WO2013123208 A1 | 8/2013 |

* cited by examiner

MARINE VESSEL CONTROL SYSTEM FOR CONTROLLING MOVEMENT OF A MARINE VESSEL HAVING FOUR PROPULSION UNITS

BACKGROUND OF THE INVENTION

Field of the Invention

The present invention relates to a marine vessel control system for docking a marine vessel and, in particular, to a marine vessel control system for docking a marine vessel with four propulsion units.

Description of the Related Art

In conventional marine vessel control systems for docking a marine vessel, an operator may use a joystick to manoeuver the marine vessel. The joystick allows the operator to manoeuver the marine vessel in a lateral direction, i.e. in a direction which is substantially perpendicular to a longitudinal axis of the marine vessel. This lateral directional movement is achieved by independently steering the propulsion units of the marine vessel to effect vector thrusting. For example, in a marine vessel provided with two propulsion units, shifting one of the propulsion units into reverse and simultaneously shifting the other propulsion unit into forward while selectively adjusting the steering angles of the propulsion units can cause the marine vessel to move in a lateral direction. The joystick controls both steering functions and shift and thrust functions during docking. These conventional marine vessel control systems are also typically provided with a helm for steering the marine vessel on open water and a control lever for controlling shift and thrusts on open water. An example of a conventional marine vessel control system for docking a marine vessel is disclosed in PCT International Application Publication Number WO 2013/123208 A1.

SUMMARY OF THE INVENTION

It is an object of the present invention to provide an improved marine vessel control system for a marine vessel which has four propulsion units.

There is accordingly provided a marine vessel control system comprising an outer port engine which has an actuator for imparting steering motion to the outer port engine and an outer starboard engine which has an actuator for imparting steering motion to the outer starboard engine. There is an inner port engine and a tie bar coupling the inner port engine to the outer port engine. There is an inner starboard engine and a tie bar coupling the inner starboard engine to the outer starboard engine. There is an input device for inputting user steering commands to the marine vessel control system in which movement of the input device actuates the said actuators to impart steering motion to the said engines. The input device may be a joystick.

There is also provided a marine vessel control system comprising an inner port engine which has an actuator for imparting steering motion to the inner port engine and an inner starboard engine which has an actuator for imparting steering motion to the inner starboard engine. There is an outer port engine and a tie bar coupling the outer port engine to the inner port engine. There is an outer starboard engine and a tie bar coupling the outer starboard engine to the inner starboard engine. There is an input device for inputting user steering commands to the marine vessel control system in which movement of the input device actuates the said actuators to impart steering motion to the said engines. The input device may be a joystick.

Thrusts of the outer port engine and the outer starboard engine may be synchronized. Thrusts of the inner port engine and the inner starboard engine may be synchronized. The thrusts of the outer port engine and the outer starboard engine may be independent of the thrusts of the inner port engine and the inner starboard engine. Toe-in angles of the inner port engine and the inner starboard engine may be adjustable based on how they are respectively coupled with the inner port engine and the inner starboard engine.

BRIEF DESCRIPTIONS OF DRAWINGS

The invention will be more readily understood from the following description of the embodiments thereof given, by way of example only, with reference to the accompanying drawings, in which.

Figure 1:
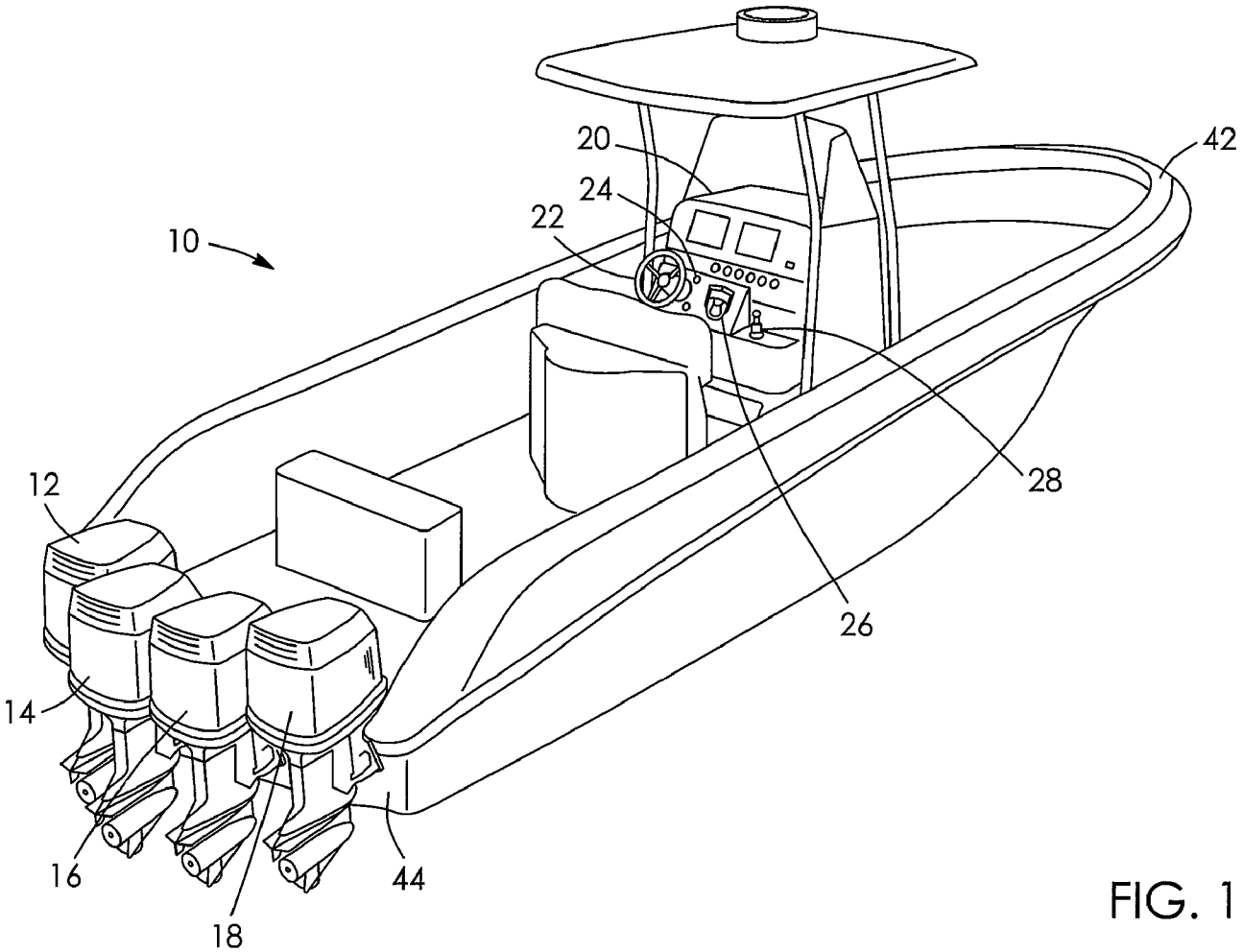
FIG. 1 is a perspective view of a marine vessel provided with a plurality of propulsion units and an improved marine vessel control system.
Figure 8:
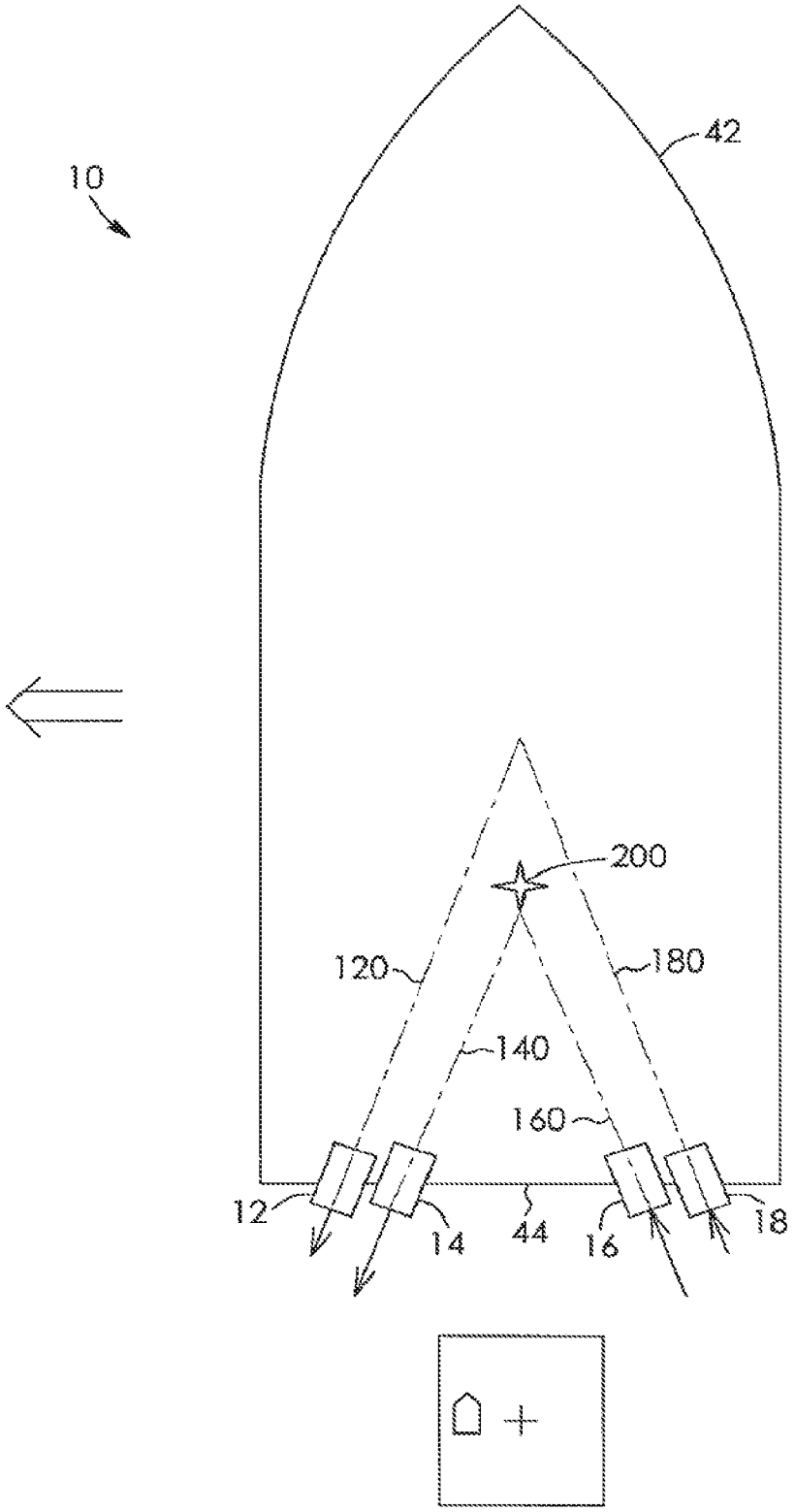
Figure 9:
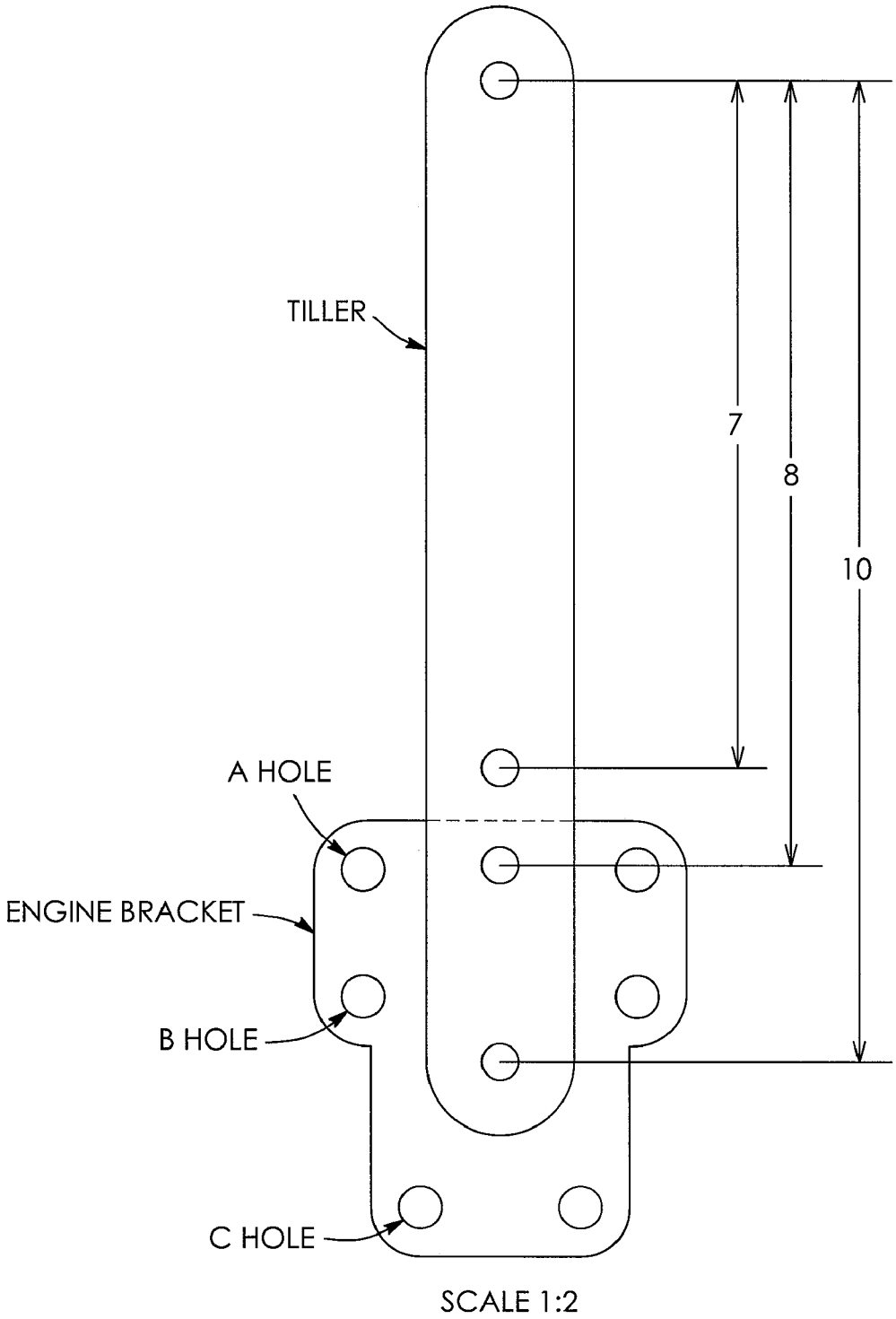
Figure 10:
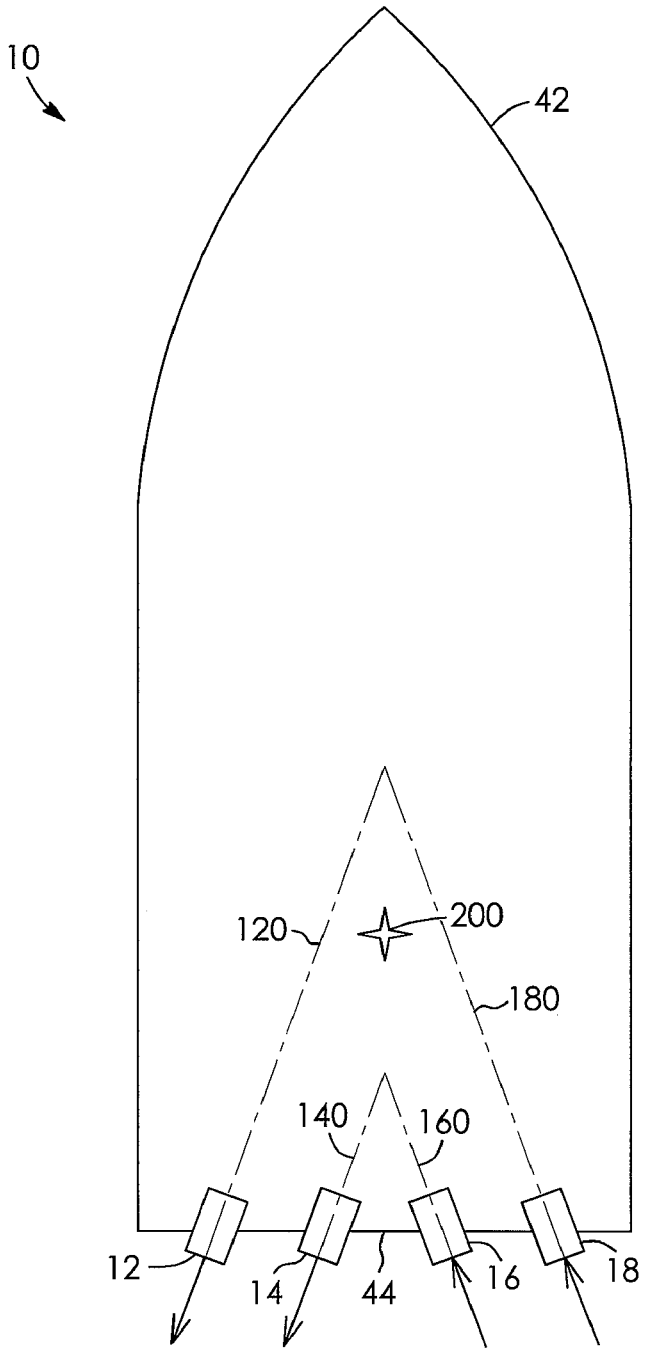
Figure 11:
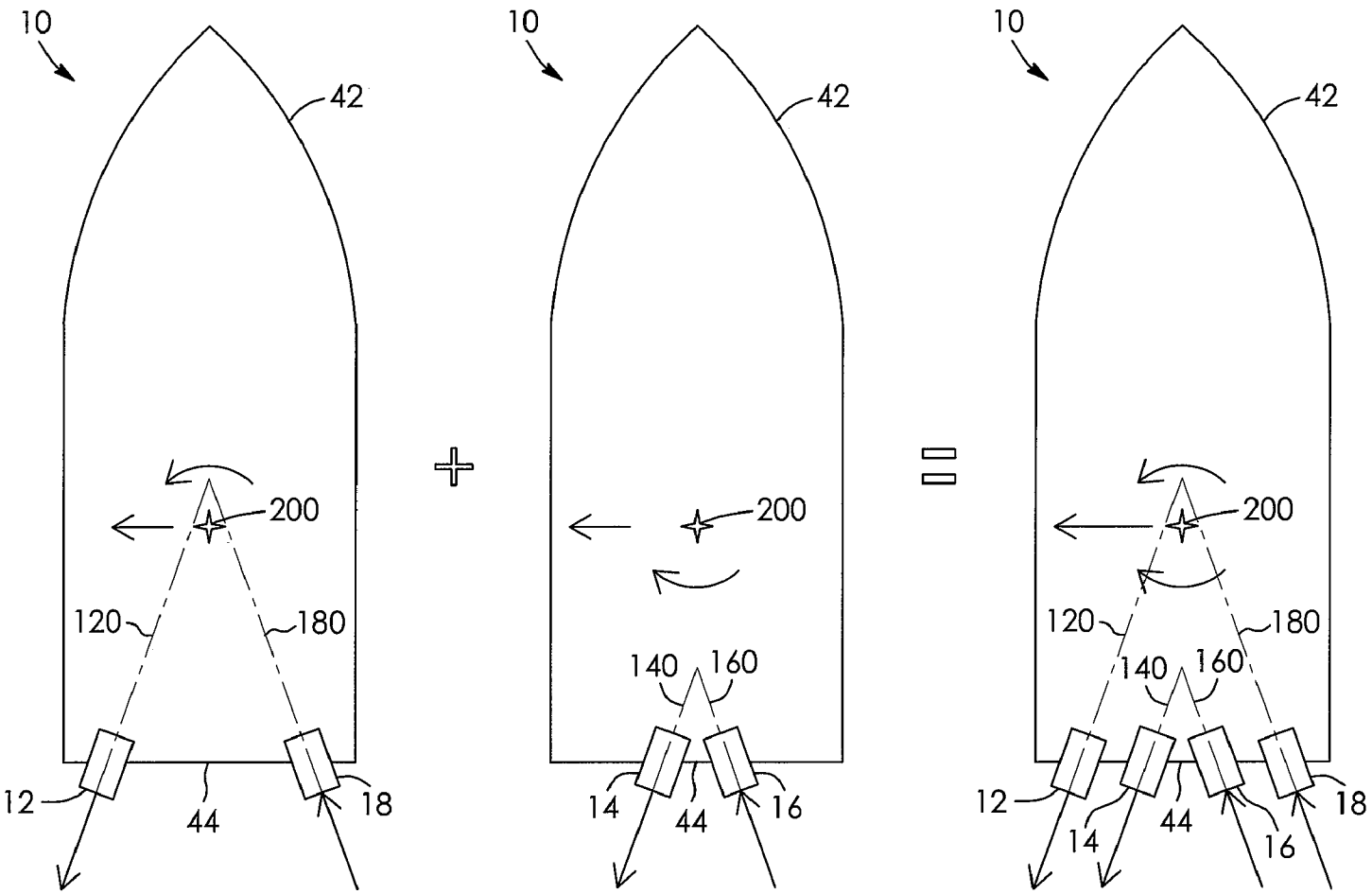
Figure 12:
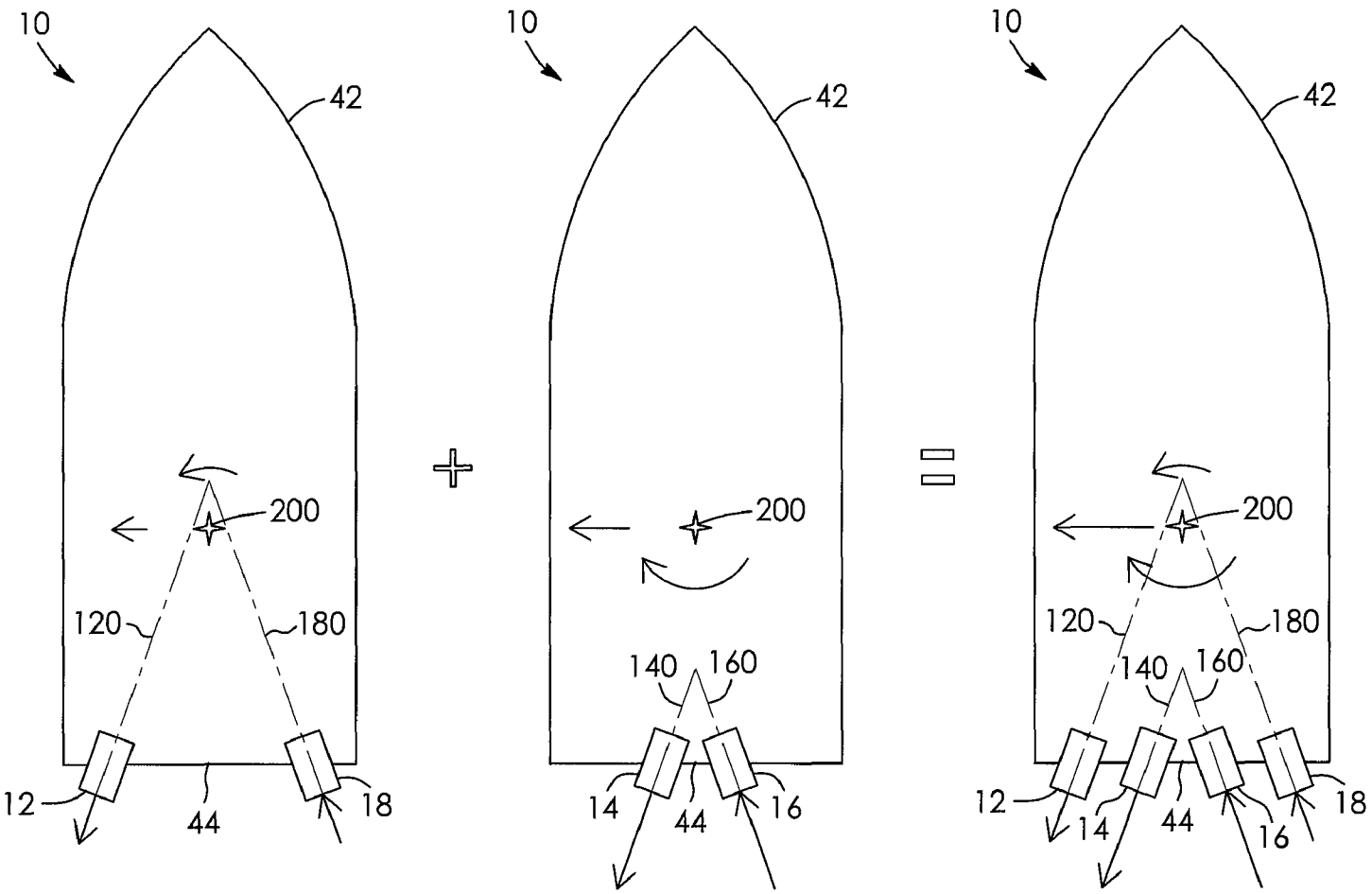

FIG. 8 is another schematic view of the marine vessel of FIG. 1 showing longitudinal axes of the outer propulsion units thereof intersecting between the instantaneous center of rotation and the bow of the marine vessel, longitudinal axes of the inner propulsion units thereof intersecting at the instantaneous center of rotation of the marine vessel, and the marine vessel being steered laterally port with the bow heading corrected;

FIG. 9 is a schematic view of a mounting bracket and a tiller of the marine vessel of FIG. 1 which are each provided with numerous mounting holes for receiving a tie-bar;

FIG. 10 is a schematic view of the marine vessel of FIG. 1 showing longitudinal axes of the outer propulsion units thereof intersecting between the instantaneous center of rotation and the bow of the marine vessel, and longitudinal axes of the inner propulsion units thereof intersecting between the stern and the instantaneous center of rotation of the marine vessel;

FIG. 11 is a schematic showing resultant forces and resultant moments of the propulsion units of FIG. 1; and FIG. 12 is another schematic showing resultant forces and resultant moments of the propulsion units of FIG. 1.

DESCRIPTIONS OF THE PREFERRED EMBODIMENTS

Referring to the drawings and first to FIG. 1, this shows a marine vessel 10 which is provided with a plurality of propulsion units in the form of four outboard engines, namely, an outer port engine 12, an inner port engine 14, an inner starboard engine 16 and an outer starboard engine 18. The marine vessel 10 is also provided with a control station 20 that supports a steering wheel 22 mounted on a helm 24, a control head 26, and an input device which in this example is a joystick 28. The control station 20 is similar to the type disclosed in PCT International Application Publication Number WO 2013/123208 A1 which was published on Aug. 22, 2013 and the full disclosure of which is incorporated herein by reference. The marine vessel 10 is accordingly provided with a control station generally similar to the type disclosed in PCT International Application Publication Number WO 2013/123208 A1 and the marine vessel 10 may be steered using either the steering wheel 22 and the helm 24 or, alternatively, the joystick 28.

Figure 2:
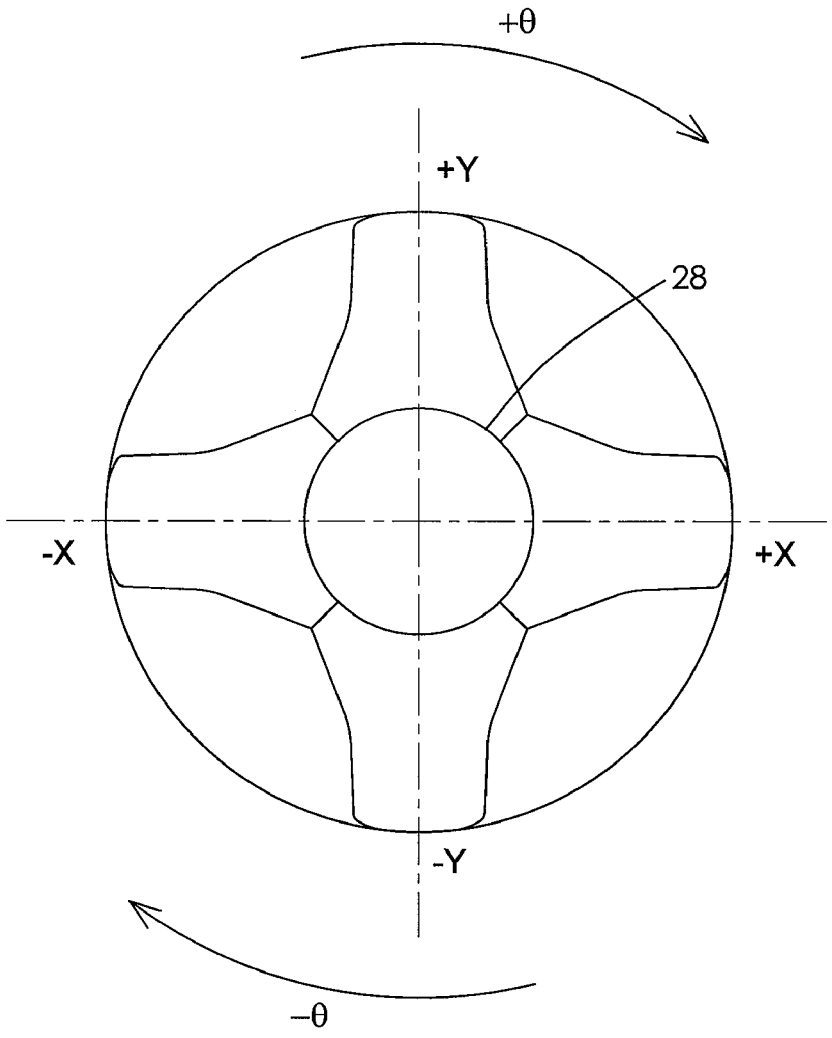
FIG. 2 is a simplified top plan view of a joystick of the marine vessel control system of FIG. 1 showing a guided plate inside the joystick and axes of movement of the joystick.
Figure 3A:
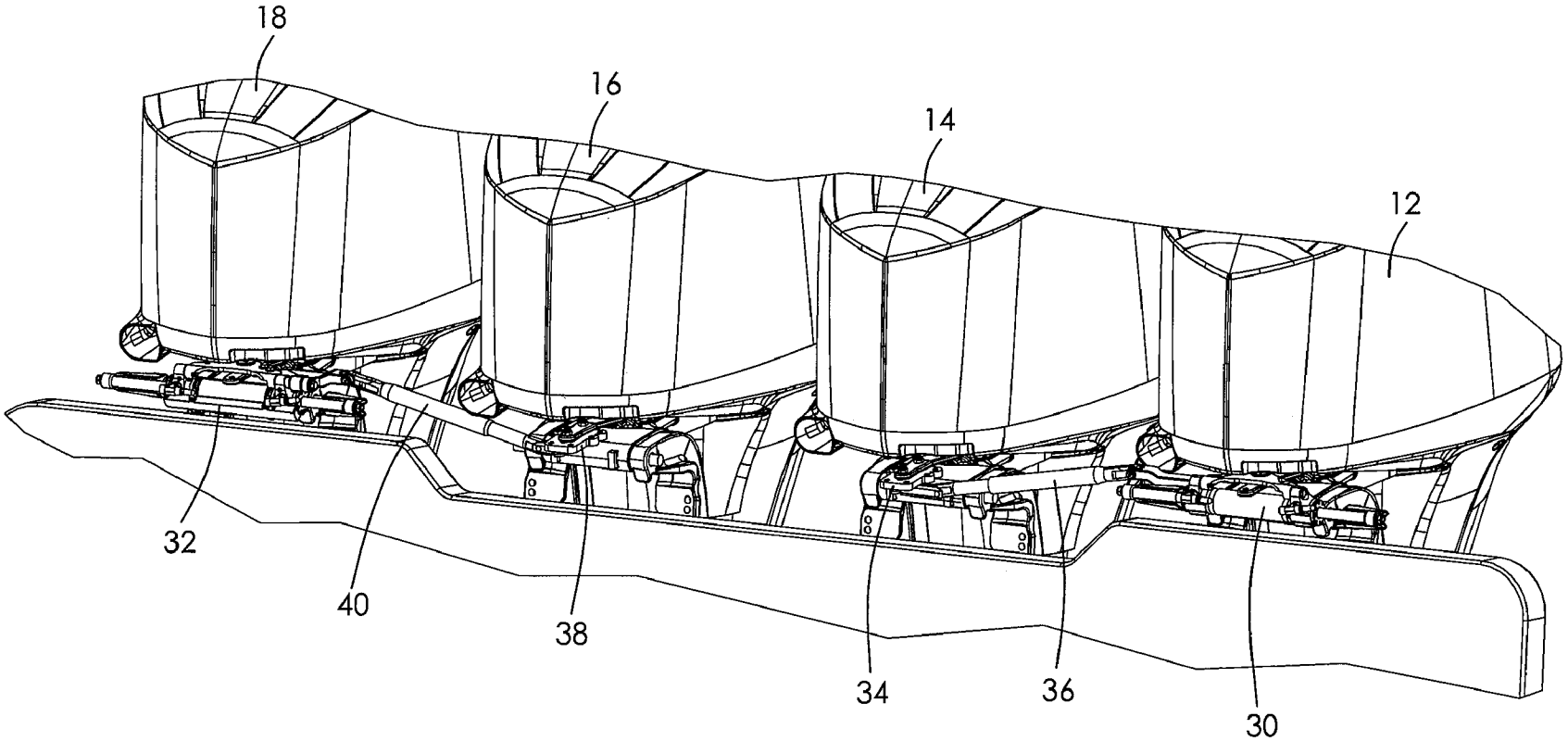
FIG. 3A is a perspective, fragmentary view of the propulsion units and the marine vessel control system of FIG. 1 showing a tiller of an inner port engine coupled to an actuator of an outer port engine by a tie bar and a tiller of an inner starboard engine coupled to an actuator of an outer starboard engine by a tie bar.

When the marine vessel 10 is steered using the joystick 28, and with reference to FIG. 2, movement of the joystick 28 along a X-axis moves the marine vessel 10 either starboard or port. Movement of the joystick 28 along a Y-axis moves the marine vessel 10 forward or in reverse. Movement of the joystick 28 along a θ-axis rotates the marine vessel 10 starboard or port. The joystick 28 is also moveable along the X-axis, Y-axis, and θ-axis to allow for vector thrusting. The joystick 28 may further be used to provide any combination of partial or full X-axis, Y-axis and θ-axis commands. Movement of the joystick 28 as described above signals a pump control module (not shown) to pump hydraulic fluid to respective hydraulic actuators 30 and 32, shown in FIG. 3A, of the outer port engine 12 and the outer starboard engine 18 based on the movement of the joystick 28. Steering motion is thereby imparted by the hydraulic actuators 30 and 32 to corresponding ones of the outer port engine 12 and the outer starboard engine 18 in a manner well known in the art.

Figure 3B:
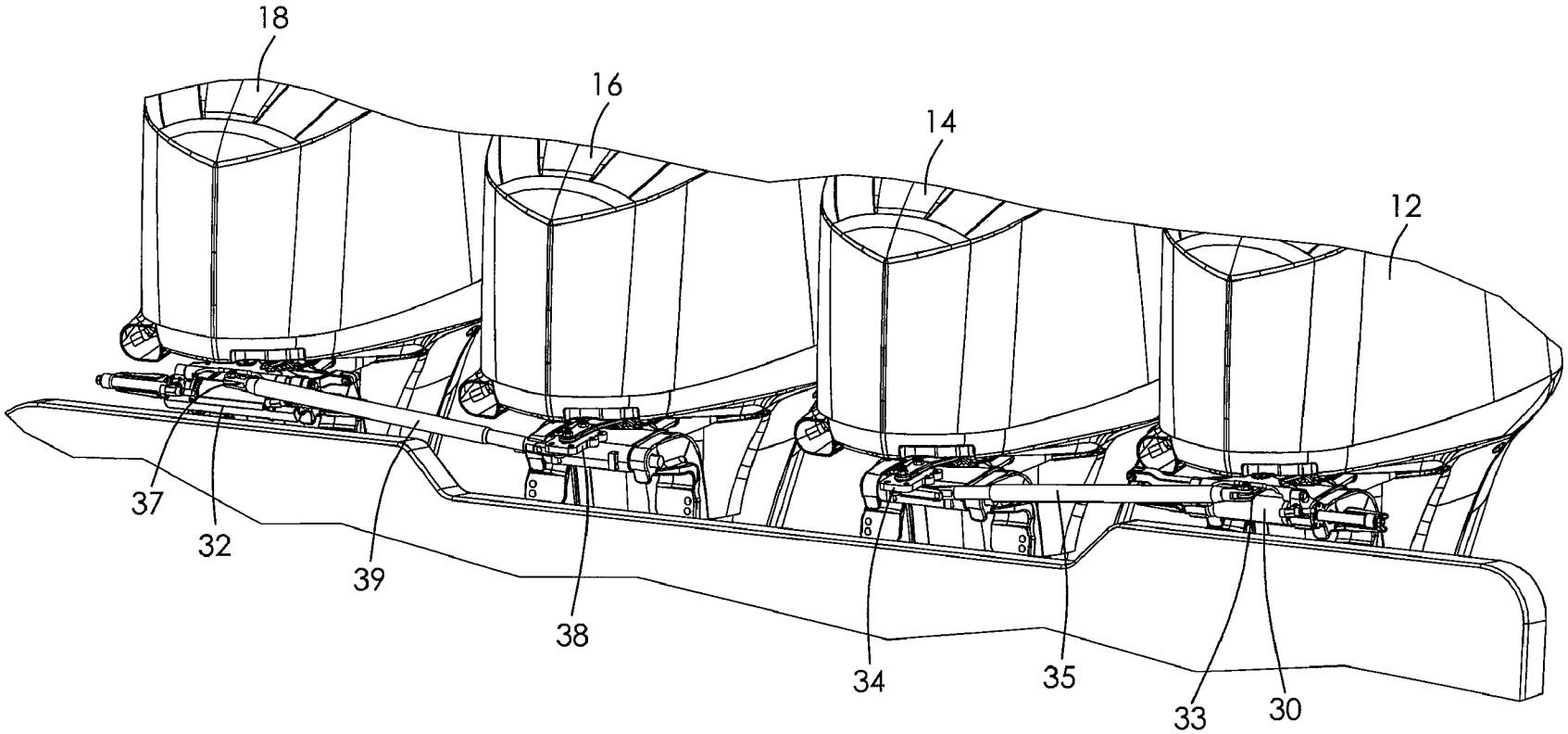
FIG. 3B is a perspective, fragmentary view of the propulsion units and the marine vessel control system of FIG. 1 showing the tiller of the inner port engine coupled to a tiller of the outer port engine by a tie bar and the tiller of the inner starboard engine coupled to a tiller of the outer starboard engine by a tie bar.

The inner port engine 14 and the inner starboard engine 16 are not provided with respective hydraulic actuators. Instead, a tiller 34 of the inner port engine 14 is coupled to the hydraulic actuator 30 of the outer port engine 12 by a tie bar 36 in this example. The tie bar 36 accordingly imparts steering motion from the hydraulic actuator 30 of the outer port engine 12 to the tiller 34 of the inner port engine 14. Likewise, a tiller 38 of the inner starboard engine 16 is coupled to the hydraulic actuator 32 of the outer starboard engine 18 by a tie bar 40 in this example. The tie bar 40 accordingly imparts steering motion from the hydraulic actuator 32 of the outer starboard engine 18 to the tiller 38 of the inner starboard engine 16. However, it will be understood by a person skilled in the art that the inner port engine 14 may be coupled to the outer port engine 12 in a different manner and the inner starboard engine 16 may be coupled to the outer starboard engine 18 in a different manner. For example, as shown in FIG. 3B, the tiller 34 of the inner port engine 14 may be coupled to a tiller 33 of the outer port engine 12 by a tie bar 35. The tie bar 35 accordingly imparts steering motion from the tiller 33 of the outer port engine 12 to the tiller 34 of the inner port engine 14. Likewise, the tiller 38 of the inner starboard engine 16 may be coupled to a tiller 37 of the outer starboard engine 18 by a tie bar 39. The tie bar 39 accordingly imparts steering motion from the tiller 37 of the outer starboard engine 18 to the tiller 38 of the inner starboard engine 16. In the examples shown in FIGS. 3A and 3B, the outer port engine 12 and the inner port engine 14 are vertically offset relative to one another and the outer starboard engine 18 and the inner starboard engine 16 are vertically offset relative to one another.

The thrusts of the outer port engine 12, the inner port engine 14, the inner starboard engine 16 and the outer starboard engine 18 may all be synchronized by the control station 20 to help keep engine thrust balanced. However, it is also possible for the control station 20 to synchronize the thrusts of the outer port engine 12 and the outer starboard engine 18 while independently synchronizing the thrusts of the inner port engine 14 and the inner starboard engine 16. This paired synchronization of the outer engines and the inner engines may be desirable when steering the marine vessel 10 in a lateral direction.

Figure 4:
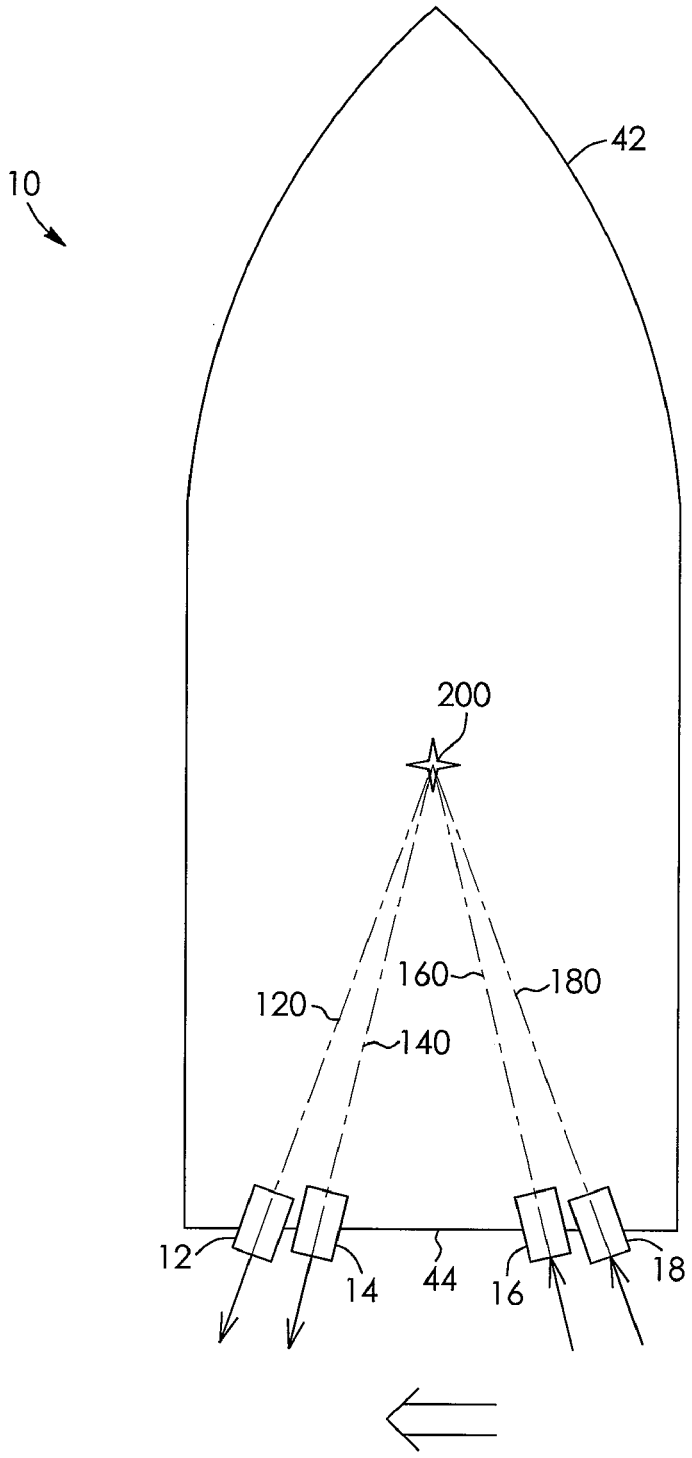
FIG. 4 is a schematic view of the marine vessel of FIG. 1 showing longitudinal axes of the propulsion units thereof intersecting at an instantaneous center of rotation of the marine vessel.

When steering the marine vessel 10 in a lateral direction, it may be desirable for the steering angle of the engines to be such that respective longitudinal axes 120, 140, 160 and 180 of the engines 12, 14, 16 and 18 each intersect with an instantaneous center of rotation 200 of the marine vessel 10. This is best shown in FIG. 4 which shows the marine vessel 10 being steered laterally port as the outer port engine 12 and the inner port engine 14 are in reverse and the inner starboard engine 16 and the outer starboard engine 18 are in forward. The thrusts of the engines are synchronized. If the steering angles of the engines are changed such that the respective longitudinal axes 120, 140, 160 and 180 of the engines 12, 14, 16 and 18 do not intersect with the instantaneous center of rotation 200 of the marine vessel 10, as shown in FIGS. 5 and 6, then a bow 42 of the marine vessel 10 will swing.

Figure 5:
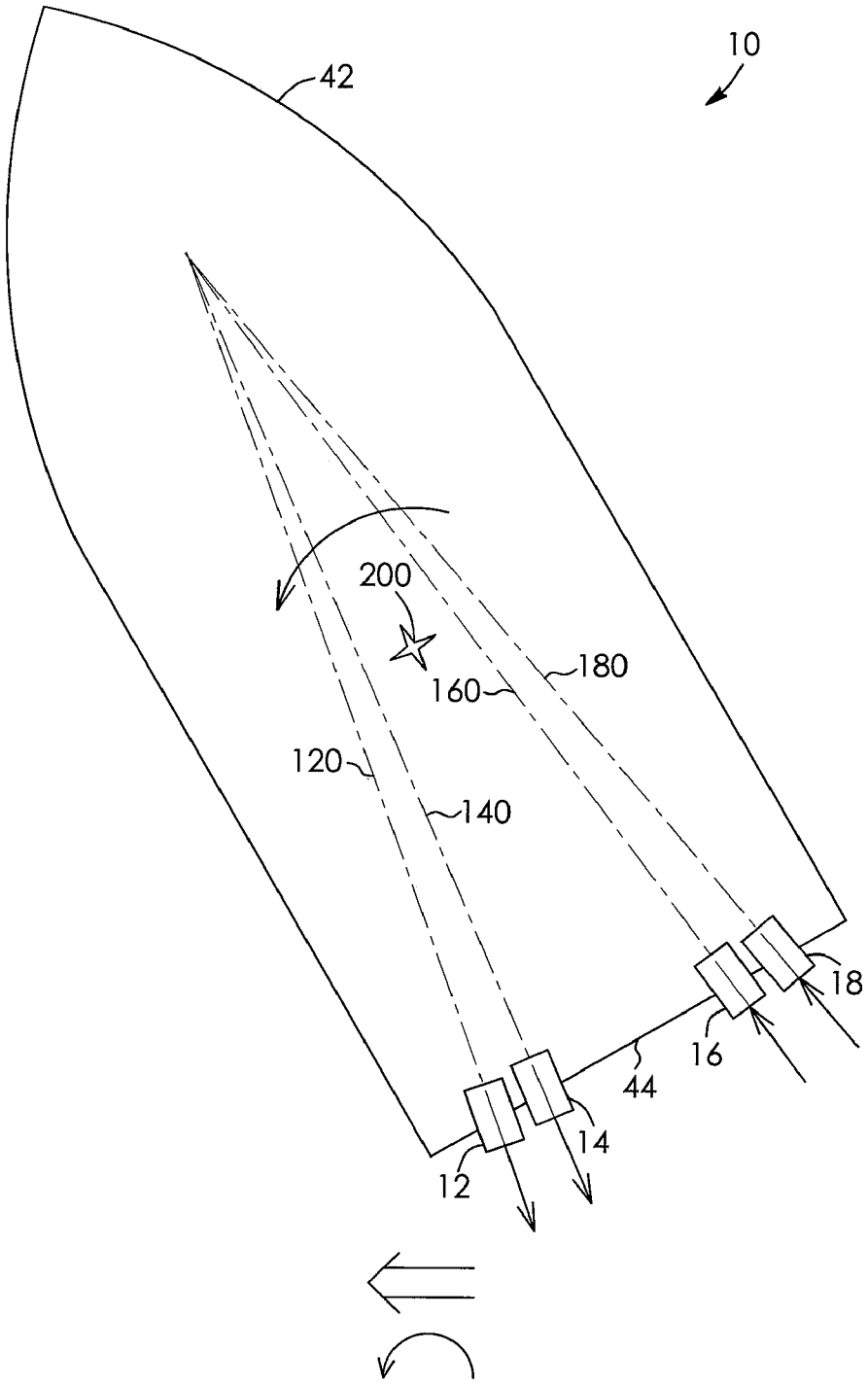
FIG. 5 is a schematic view of the marine vessel of FIG. 1 showing longitudinal axes of the propulsion units thereof intersecting between the instantaneous center of rotation and a bow of the marine vessel.
Figure 6:
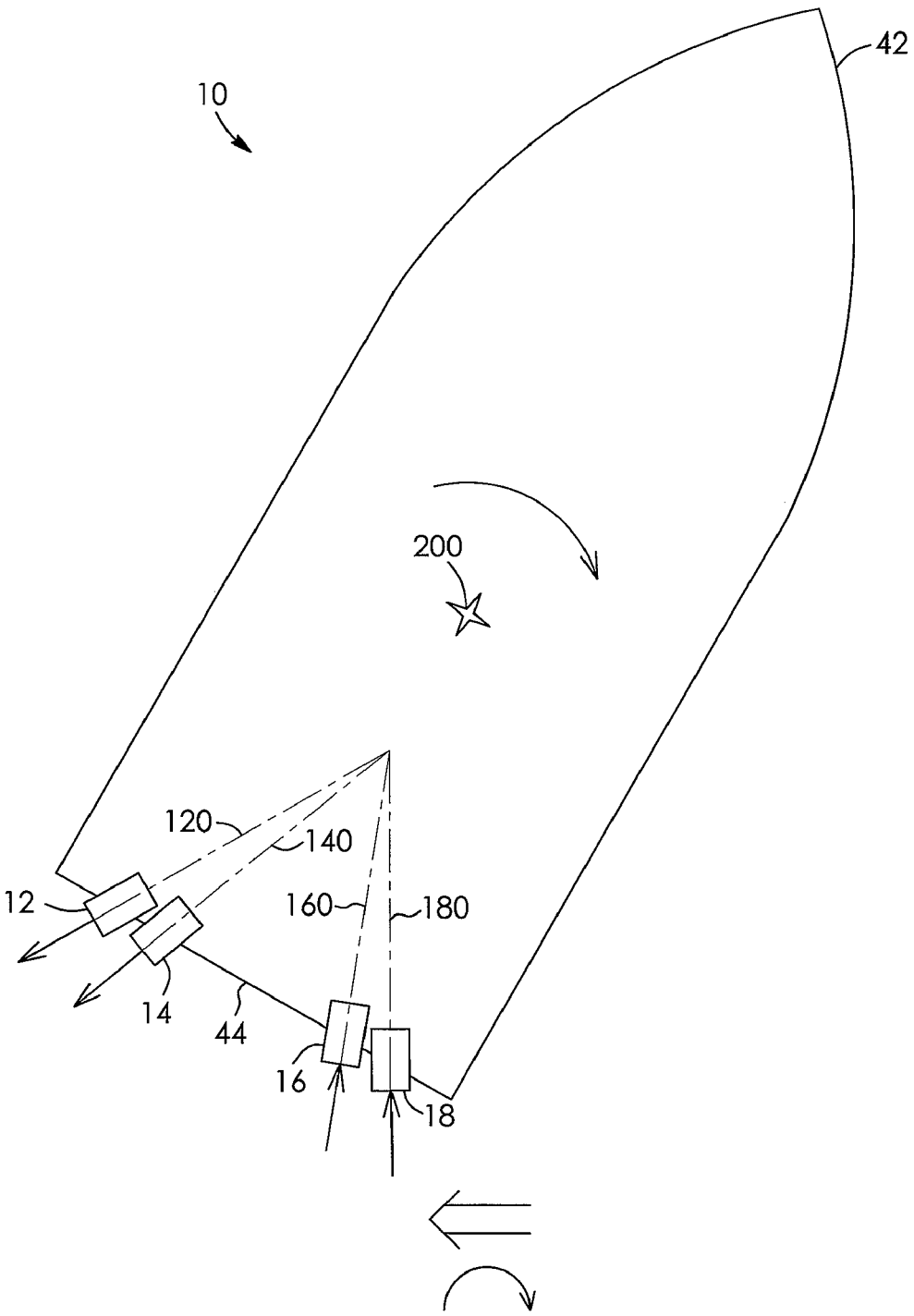
FIG. 6 is a schematic view of the marine vessel of FIG. 1 showing longitudinal axes of the propulsion units thereof intersecting between a stern of the marine vessel and the instantaneous center of rotation.

When the respective longitudinal axes 120, 140, 160 and 180 of the engines 12, 14, 16 and 18 intersect closer to the bow 42, as shown in FIG. 5, the bow 42 will swing port when the outer port engine 12 and the inner port engine 14 are in reverse and the inner starboard engine 16 and the outer starboard engine 18 are in forward. When the respective longitudinal axes 120, 140, 160 and 180 of the engines 12, 14, 16 and 18 intersect closer to a stern 44 of the marine vessel 10, as shown in FIG. 6, the bow 42 will swing starboard when the outer port engine 12 and the inner port engine 14 are in reverse and the inner starboard engine 16 and the outer starboard engine 18 are in forward. It will be understood by a person skilled in the art that the marine vessel 10 will move in opposite directions when the outer port engine 12 and the inner port engine 14 are in forward and the inner starboard engine 16 and the outer starboard engine 18 are in reverse. It may therefore be desirable to keep the steering angles of the engines such that the respective longitudinal axes 120, 140, 160 and 180 of the engines 12, 14, 16 and 18 each intersect with the instantaneous center of rotation 200 of the marine vessel 10 when the marine vessel is being steered laterally port or laterally starboard.

Figure 7:
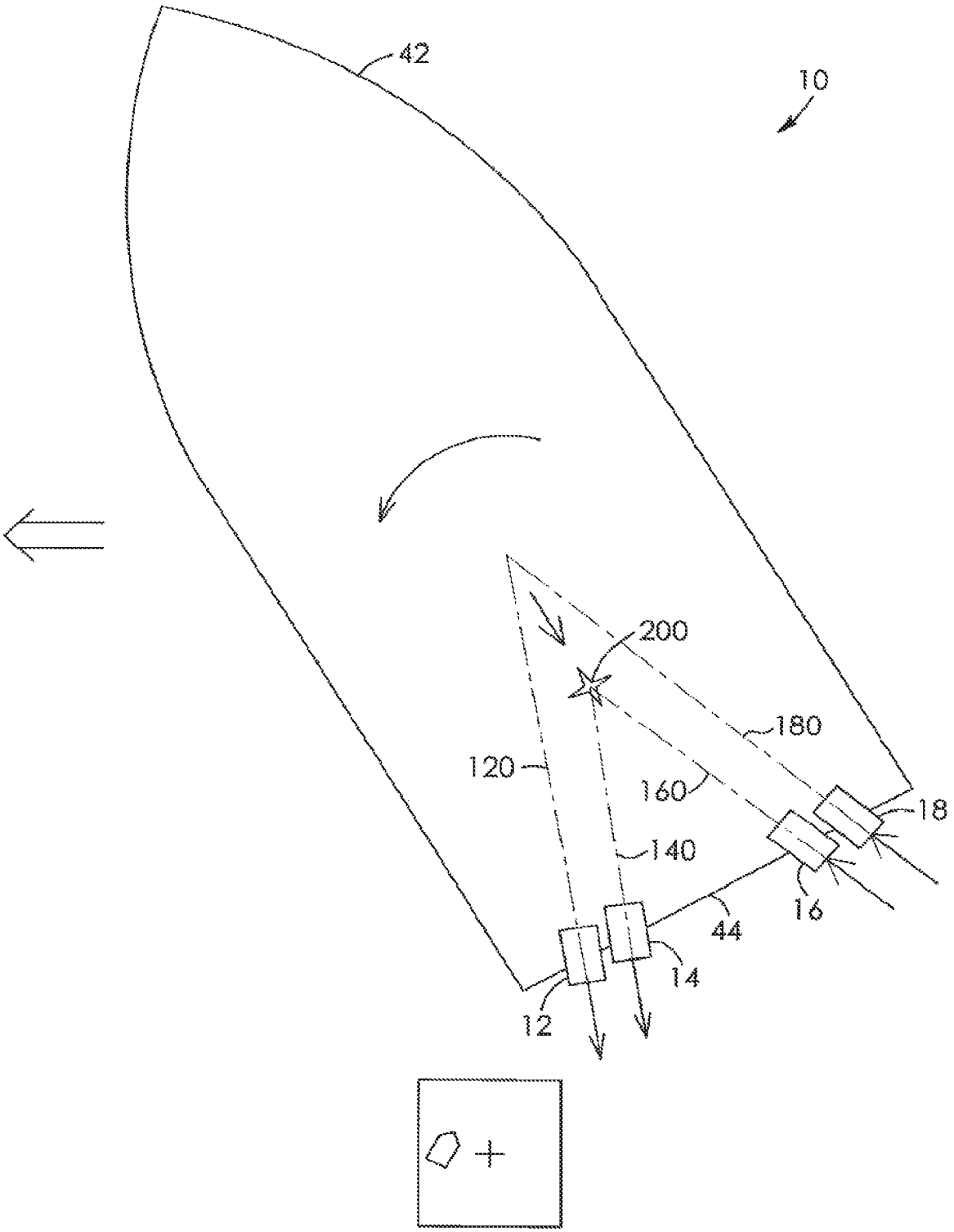
FIG. 7 is a schematic view of the marine vessel of FIG. 1 showing longitudinal axes of the outer propulsion units thereof intersecting between the instantaneous center of rotation and the bow of the marine vessel, longitudinal axes of the inner propulsion units thereof intersecting at the instantaneous center of rotation of the marine vessel, and the marine vessel being steered laterally port.

Generally the instantaneous center of rotation 200 of the marine vessel 10 will be at a center of gravity of the marine vessel. There may however be certain situations in which the instantaneous center of rotation 200 of the marine vessel 10 does not correspond with the center of gravity of the marine vessel 10. In these situations, when the instantaneous center of rotation 200 is no longer at the center of gravity of the marine vessel, it is necessary to adjust the steering angles of the engines 12, 14, 16 and 18 to prevent the bow from swinging or correct the bow heading. However, problems may arise if the instantaneous center of rotation 200 is moved towards the stern 44 of the marine vessel 10 such that the respective longitudinal axes 120 and 180 of the outer port engine 12 and the outer starboard engine 18 cannot intersect with the instantaneous center of rotation 200. Since, at their maximum steering angle, the respective longitudinal axes 120 and 180 of the outer port engine 12 and the outer starboard engine 18 will intersect closer to the bow 42 than the instantaneous center of rotation 200, as shown in FIG. 7, the bow 42 will swing port when the outer port engine 12 and the inner port engine 14 are in reverse and the inner starboard engine 16 and the outer starboard engine 18 are in forward.

The respective longitudinal axes 140 and 160 of the inner port engine 14 and the inner starboard engine 16 can however intersect at the instantaneous center of rotation 200 in the marine vessel control system disclosed herein. Accordingly, reducing the thrust of the outer port engine 12 and the outer starboard engine 18 while maintaining the thrust of the inner port engine 14 and the inner starboard engine 16 will correct the bow heading as shown in FIG. 8. This is because stronger thrust from the inner port engine 14 and the inner starboard engine 16 will swing the bow 42 starboard to compensate for the outer port engine 12 and the outer starboard engine 18 swinging the bow 42 port. This correction or adjustment in thrust may be done automatically based on the movement of the joystick 28. For example, the heading correction logic may activate automatically in response to certain parameters.

The respective longitudinal axes 140 and 160 of the inner port engine 14 and the inner starboard engine 16 are able to intersect at of the instantaneous center of rotation 200 disposed towards the stern 44 of the marine vessel 10 due to asymmetric coupling of the inner engines 14 and 16 to the corresponding outer engines 12 and 18. This is accomplished by providing multiple mounting holes, for example mounting holes A, B and C, on a bracket coupled to a tiller as shown in FIG. 9. The tiller also has a plurality of mounting holes 7 inches, 8 inches, and 10 inches along its length. This allows for non-linear engine angle options between connected engines. The tables below show the steering angles of the outer engines and the inner engines at intersection points of the longitudinal axes of the engines when a tie bar is secured to the various mounting holes.

TABLE 1

Calculates the distance from the back of the marine vessel to the intersection point of the longitudinal axes of the engines and the marine vessel centerline, along the marine vessel centerline.

| | | | | Inner Engines | | | |
|---|---|---|---|---|---|---|---|
| Outer Engines | | A Hole | | B Hole | | C Hole | |
| Steering Angle | Intersection Point distance | Steering Angle | Intersection Point distance | Steering Angle | Intersection Point distance | Steering Angle | Intersection Point distance |
| −27.5 | −80.68 | 29.02 | 25.24 | −24.25 | −31.08 | −19.4 | −39.76 |
| −25 | −90.07 | −26.21 | −28.44 | −22.01 | −34.63 | −17.65 | −44.00 |
| −20 | −115.39 | −20.73 | −36.99 | −17.55 | −44.27 | −14.14 | −55.57 |
| −15 | −156.75 | −15.39 | −50.86 | −13.11 | −60.11 | −10.6 | −74.81 |
| −10 | −238.19 | −10.17 | −78.04 | −8.7 | −91.49 | −7.04 | −113.37 |
| −5 | −480.06 | −5.04 | −158.74 | −4.33 | −184.90 | −3.49 | −229.56 |
| 0 | Infinity | 0 | Infinity | 0 | Infinity | 0 | Infinity |

TABLE 2

Calculates what steering angle the center engines would need to be on to point to the same intersection point.

| Outer Engines Steering Angle | Intersection Point distance | Steering angle required on inner engines to achieve same COS distance |
|---|---|---|
| −27.5 | −80.68 | −9.844077611 |
| −25 | −90.07 | −8.835119873 |
| −20 | −115.39 | −6.917511166 |
| −15 | −156.75 | −5.103909361 |
| −10 | −238.19 | −3.363727412 |
| −5 | −480.06 | −1.670436945 |
| 0 | Infinity | Infinity |

The marine vessel control system disclosed herein also smoothly turns the marine vessel or corrects bow heading when neither the respective longitudinal axes 120 and 180 of the outer engines 12 and 18 nor the respective longitudinal axes 140 and 160 of the inner engines 14 and 16 can intersect at the instantaneous center of rotation 200.

FIG. 10 is a schematic view of the marine vessel 10 showing the respective longitudinal axes 120 and 180 of the outer engines 12 and 18 intersecting between the instantaneous center of rotation 200 and the bow 42 of the marine vessel, and the respective longitudinal axes 140 and 160 of the inner engines 14 and 16 intersecting between the stern 44 and the instantaneous center of rotation 200 of the marine vessel.

FIG. 11 is a schematic showing resultant forces and resultant moments of the engines 12, 14, 16 and 18. The outer engines 12 and 18 function as a pair and the inner engines 14 and 16 function as a pair. Control actions and gear shift timing of the paired engines are synchronized. Throttle control of the paired engines is also synchronized such that a lateral thrust and a resultant moment are generated. When the paired outer engines 12 and 18 generate a thrust towards port and a counter-clockwise resultant moment, a thrust intersection point of the paired outer engines is fore of the instantaneous center of rotation 200 of the marine vessel 10. When the paired inner engines 14 and 16 generate a thrust towards port and a clockwise resultant moment, a thrust intersection point of the paired inner engines is aft of the instantaneous center of rotation 200 of the marine vessel 10. The resultant moment of the paired outer engines 12 and 18 is equal in magnitude and opposite in direction to the resultant moment of the paired inner engines 14 and 16 so that a net zero moment is generated. The two resultant forces of the paired outer engines 12 and 18 and the paired inner engines 14 and 16 together push the marine vessel 10 towards port and are thus summed together. This is a base case for pure lateral translation.

FIG. 12 is another schematic showing resultant forces and resultant moments of the engines 12, 14, 16 and 18. The outer engines 12 and 18 function as a pair and the inner engines 14 and 16 function as a pair. When the paired outer engines 12 and 18 generate a thrust towards port and a counter-clockwise resultant moment, a thrust intersection point of the paired outer engines is fore of the instantaneous center of rotation 200 of the marine vessel 10. When the paired inner engines 14 and 16 generate a thrust towards port and a clockwise resultant moment, a thrust intersection point of the paired inner engines is aft of the instantaneous center of rotation 200 of the marine vessel 10. The thrust and moment generated from the paired outer engines 12 and 18 are reduced compared to the case shown in FIG. 11. The thrust and moment generated from the paired inner engines 14 and 16 may be increased compared to the case shown in FIG. 11. The two resultant forces of the paired outer engines and the paired inner engines both push the marine vessel 10 towards port and are thus summed added together. The thrusts of the outer port engine and the outer starboard engine are less than the thrusts of the inner port engine and the inner starboard engine. Since the paired inner engines 14 and 16 generate a much higher moment than that of the paired outer engines 12 and 18, the resultant action swings the bow 42 of the marine vessel 10 towards a clockwise direction as shown in FIG. 12.

Heading correction during lateral translation is a required function for marine vessel control using the joystick. As the marine vessel travels sideways, current and wind may often swing the bow of the marine vessel in the opposite direction of the lateral movement direction. Due to steering angle limitations on outboard engines, the thrust intersection point of the outer engines may still point towards the fore of the instantaneous center of rotation even if the outer engines are all the way toed-in. It is therefore advantageous and effective to increase the thrust of the paired inner engines since the thrust intersection point of the paired inner engines is much further to the aft of the center of rotation. At the same time, the thrusts of the paired outer engines are reduced so that the heading of the marine vessel is corrected in the right direction.

It will be understood by a person skilled in the art that the marine vessel control system is shown herein having outer engines with actuators for imparting steering motion to the outer engines and tie bars coupling the inner engines to the outer engines by way of example only. The marine vessel control system may also have inner engines with actuators for imparting steering motion to the inner engines and tie bars coupling the outer engines to the inner engines.

It will further be understood by a person skilled in the art that many of the details provided above are by way of example only, and are not intended to limit the scope of the invention which is to be determined with reference to the following claims.

What is claimed is:

1. A marine vessel control system for a marine vessel, the marine vessel control system comprising:

an outer port engine;

an inner port engine;

an outer starboard engine;

an inner starboard engine;

actuators operable to impart steering motion to the outer port engine, the inner port engine, the outer starboard engine, and the inner starboard engine; and an input device for inputting user steering commands to the marine vessel control system, wherein when a thrust intersection point of the outer port engine and the outer starboard engine is fore of an instantaneous center of rotation of the marine vessel and a thrust intersection point of the inner port engine and the inner starboard engine is aft of the instantaneous center of rotation of the marine vessel, the marine vessel control system is operable to cause, in response to the input device indicating movement of the marine vessel in only a lateral direction, thrusts of the outer port engine and the outer starboard engine to be less than thrusts of the inner port engine and the inner starboard engine.

2. The marine vessel control system as claimed in claim 1, wherein:

the thrusts of the outer port engine and the outer starboard engine are synchronized;

the thrusts of the inner port engine and the inner starboard engine are synchronized; and the thrusts of the outer port engine and the outer starboard engine are independent of the thrusts of the inner port engine and the inner starboard engine.

3. The marine vessel control system as claimed in claim 1, wherein toe-in angles of the inner port engine and the inner starboard engine are adjustable.

4. The marine vessel control system as claimed in claim 1, wherein the input device is a joystick.

5. The marine vessel control system as claimed in claim 1, wherein:

the inner port engine is coupled to the outer port engine; and the inner starboard is coupled to the outer starboard engine.

6. The marine vessel control system as claimed in claim 5, further comprising:

a first tie bar coupling the inner port engine to the outer port engine; and a second tie bar coupling the inner starboard to the outer starboard engine.

7. The marine vessel control system as claimed in claim 6 wherein the actuators comprise:

a first actuator operable to impart steering motion to the inner port engine and to the outer port engine; and a second actuator operable to impart steering motion to the inner starboard engine and to the outer starboard engine.

8. The marine vessel control system as claimed in claim 5, wherein the actuators comprise:

a first actuator operable to impart steering motion to the inner port engine and to the outer port engine; and a second actuator operable to impart steering motion to the inner starboard engine and to the outer starboard engine.

9. The marine vessel control system as claimed in claim 5, wherein:

the inner port engine is coupled to the outer port engine such that angle changes of the inner port engine are non-linearly related to angle changes of the outer port engine; and the inner starboard engine is coupled to the outer starboard engine such that angle changes of the inner starboard engine are non-linearly related to angle changes of the outer starboard engine.

10. The marine vessel control system as claimed in claim 1, wherein the marine vessel control system is operable to cause the thrusts of the outer port engine and the outer starboard engine to be less than the thrusts of the inner port engine and the inner starboard engine in response to:

the input device indicating the movement of the marine vessel in only the lateral direction; and the thrust intersection point of the outer port engine and the outer starboard engine being farther from the instantaneous center of rotation of the marine vessel than the thrust intersection point of the inner port engine and the inner starboard engine.

11. A marine vessel, comprising:

an outer port engine;

an inner port engine;

an outer starboard engine;

an inner starboard engine;

actuators operable to impart steering motion to the outer port engine, the inner port engine, the outer starboard engine, and the inner starboard engine; and a marine vessel control system comprising an input device for inputting user steering commands to the marine vessel control system, wherein when a thrust intersection point of the outer port engine and the outer starboard engine is fore of an instantaneous center of rotation of the marine vessel and a thrust intersection point of the inner port engine and the inner starboard engine is aft of the instantaneous center of rotation of the marine vessel, the marine vessel control system is operable to cause, in response to the input device indicating movement of the marine vessel in only a lateral direction, the thrusts of the outer port engine and the outer starboard engine to be less than the thrusts of the inner port engine and the inner starboard engine.

12. The marine vessel as claimed in claim 11, wherein:

thrusts of the outer port engine and the outer starboard engine are synchronized;

thrusts of the inner port engine and the inner starboard engine are synchronized; and the thrusts of the outer port engine and the outer starboard engine are independent of the thrusts of the inner port engine and the inner starboard engine.

13. The marine vessel as claimed in claim 12, wherein the marine vessel control system is operable to cause the thrusts of the outer port engine and the outer starboard engine to be less than the thrusts of the inner port engine and the inner starboard engine in response to:

the input device indicating the movement of the marine vessel in only the lateral direction; and the thrust intersection point of the outer port engine and the outer starboard engine being farther from the instantaneous center of rotation of the marine vessel than the thrust intersection point of the inner port engine and the inner starboard engine.

14. The marine vessel as claimed in claim 11, wherein toe-in angles of the inner port engine and the inner starboard engine are adjustable.

15. The marine vessel as claimed in claim 11, wherein the input device is a joystick.

16. The marine vessel control system as claimed in claim 11, wherein:

the inner port engine is coupled to the outer port engine; and the inner starboard is coupled to the outer starboard engine.

17. The marine vessel as claimed in claim 16, further comprising:

a first tie bar coupling the inner port engine to the outer port engine; and a second tie bar coupling the inner starboard to the outer starboard engine.

18. The marine vessel as claimed in claim 17, wherein the actuators comprise:

a first actuator operable to impart steering motion to the inner port engine and to the outer port engine; and a second actuator operable to impart steering motion to the inner starboard engine and to the outer starboard engine.

19. The marine vessel as claimed in claim 16, wherein the actuators comprise:

a first actuator operable to impart steering motion to the inner port engine and to the outer port engine; and a second actuator operable to impart steering motion to the inner starboard engine and to the outer starboard engine.

20. The marine vessel as claimed in claim 16, wherein:

the inner port engine is coupled to the outer port engine such that angle changes of the inner port engine are non-linearly related to angle changes of the outer port engine; and the inner starboard engine is coupled to the outer starboard engine such that angle changes of the inner starboard engine are non-linearly related to angle changes of the outer starboard engine.

* * * * *